United States Patent [19]

Schumann

[11] 4,183,199

[45] Jan. 15, 1980

[54] APPARATUS FOR BRINGING TO REST THE ROTOR OF AN OPEN-END SPINNING DEVICE

[75] Inventor: Fritz Schumann, Ingolstadt, Fed. Rep. of Germany

[73] Assignee: Schubert & Salzer, Ingolstadt, Fed. Rep. of Germany

[21] Appl. No.: 878,654

[22] Filed: Feb. 16, 1978

[30] Foreign Application Priority Data

Feb. 19, 1977 [DE] Fed. Rep. of Germany ..... 2707309

[51] Int. Cl.[2] ..... D01H 7/22; D01H 1/12

[52] U.S. Cl. ..... 57/89; 57/58.89; 57/105

[58] Field of Search ..... 57/58.89–58.95, 57/88, 89, 104, 105

[56] References Cited

U.S. PATENT DOCUMENTS

| | | | |
|---|---|---|---|
| 3,375,649 | 4/1968 | Bures et al. | 57/89 X |
| 3,805,506 | 4/1974 | Stahlecker | 57/105 X |
| 3,838,560 | 10/1974 | Stahlecker | 57/58.89 |
| 3,868,815 | 3/1975 | Stahlecker | 57/88 |
| 4,070,814 | 1/1978 | Goldammer et al. | 57/89 |

FOREIGN PATENT DOCUMENTS

| | | | |
|---|---|---|---|
| 1913728 | 8/1970 | Fed. Rep. of Germany | 57/58.89 |
| 2333091 | 1/1975 | Fed. Rep. of Germany . | |

*Primary Examiner*—John Petrakes

*Attorney, Agent, or Firm*—Bailey, Dority & Flint

[57] ABSTRACT

An apparatus for bringing to rest the rotor of an open-end spinning device, the shaft of which rotor is mounted in a wedge gap formed by freely rotatable support rollers and being pressed against the support rollers and driven by a tangential belt. An axial force arising from the support rollers presses the rotor shaft against an axial stop and in bringing the spinning apparatus to rest the shaft is moved away from the normal running position on the support rollers to an arrested position off of the support rollers. The shaft extends through bores provided in a pair of spaced bearings. A conically tapering section is provided on the shaft which engages a correspondingly conically shaped wall of the bore for applying an axial force to the shaft when the shaft is moved from the running position to the arrested position.

2 Claims, 2 Drawing Figures

APPARATUS FOR BRINGING TO REST THE ROTOR OF AN OPEN-END SPINNING DEVICE

BACKGROUND OF THE INVENTION

The present invention relates to an apparatus for bringing to rest the rotor of an open-end spinning device, the shaft of which is mounted in a tapered gap formed by freely rotatable supporting rollers and is pressed against the support rollers and driven by a tangential belt, as disclosed in West German Auslegeschrift 2,525,435.

This known apparatus has a lever which is pivotable about an axis and which has a belt-lifter roller and a support that receives the shaft. On movement of the lever towards the tangential belt, the belt is lifted from the shaft by the belt-lifter roller, and then the shaft is moved by the support away from the support rollers and is pressed against stops constructed as support bearings. A reliable bringing to rest of the rotor, with little wear, is insured, since the drive process is precisely separated from the braking process and the influence of the inertial masses of the support rollers on the rotor is excluded. Here the axial securement of the rotor shaft can be effected by a gearwheel which engages in a recess of the rotor shaft or by an axial force acting on the rotor shaft, with the rotor shaft supported by its free end on a thrust bearing.

However, to the extent that the axial force arises from the support rollers, an accurate securement of the rotor and of the rotor shaft is not provided at the moment when, during braking, the rotor shaft is lifted from the support pulleys. Unwanted displacements of the rotor in the axial direction can occur.

SUMMARY OF THE INVENTION

The problem of axial fixation of the rotor is solved according to the invention by providing on the shaft, in the region of at least one of the stops, a section which concially tapers against the axial support direction, and by giving the stop a conicity corresponding to this shaft section. Replacement of the rotor by pulling it out of its mounting is made possible by making the smallest internal diameter of the concially structured stop at least equal to the diameter of the cylindrical part of the shaft.

Accordingly, it is an object of the present invention to provide an axial fixation of the rotor shaft during the braking shaft of the rotor on an open-end spinning machine.

Another important object of the present invention is to provide a conical surface on the rotor of an open-end spinning device which contacts a correspondingly sloped surface on a stop when being brought to rest for obtaining axial fixation of the roller.

These and other objects and advantages of the invention will become apparent upon reference to the following specification, attendant claims and drawing.

DESCRIPTION OF A PREFERRED EMBODIMENT

Figure 1:
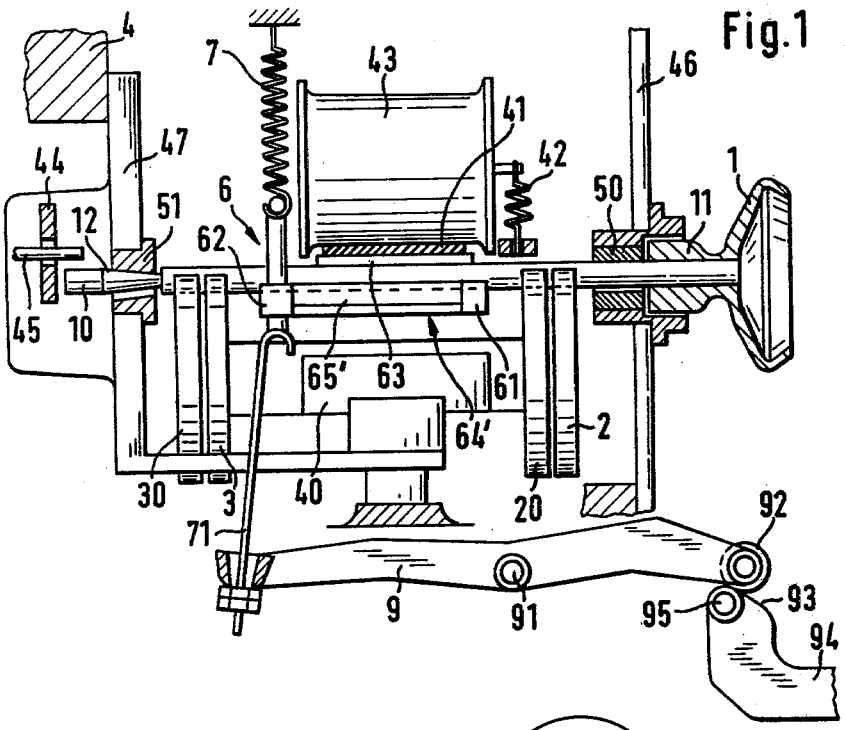
FIG. 1 shows a side view of the stopping device, with conically constructed rotor shaft and stop.
Figure 2:
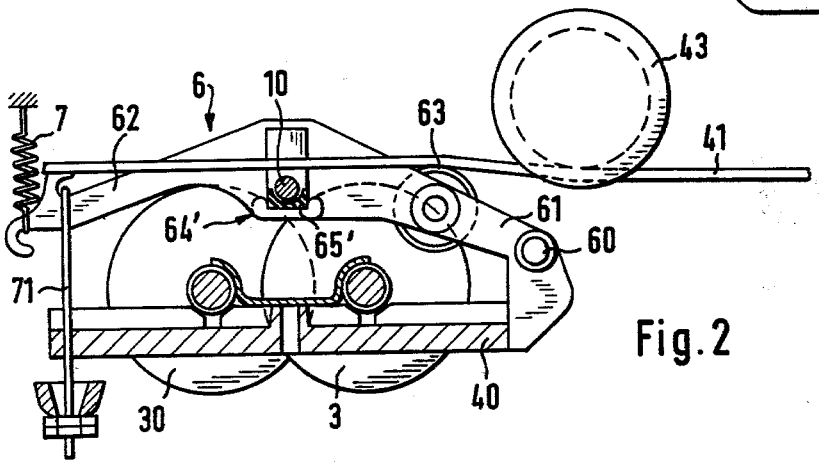
FIG. 2 shows a front sectional view of the device according to FIG. 1, with unimportant parts omitted.

The horizontally-arranged shaft 10 of a spinning assembly of an open-end spinning apparatus carries a rotor 1 with a collar 11 and is mounted in the tapered gap formed by the roller pairs 2, 20 and 3, 30, which are attached to a mounting block 40. A tangential belt 41 drives the shaft 10 and the rotor 1 attached to it. The tangential belt 41 is pressed against the shaft 10 by a tensioning roller 43 which is under the pressure of a spring 42, so that the shaft 10, when running, is pressed against the support rollers 2, 20 and 3, 30 and is located in the radial direction. The axial securement of the shaft 10 while running is effected by an axial stop 44 in the form of a washer which is rotatably mounted on a stationary shaft 45 and against which the shaft 10 is pressed with its free end by an axial force exerted by the support rollers.

Two stops 50 and 51, constructed as support bearings, are associated with the shaft 10 and are conveniently each arranged in a respective bore of a stationary mounting plate 47 and a wall 46 which forms the back wall of the spinning chamber receiving rotor 1 and together with a housing part 4 (only a portion shown) encloses the whole mounting. Preferably, the stops 50 and 51 annularly surround the shaft and are constructed as slide bearings. Their internal diameter corresponds to the diameter of the shaft 10 together with a length of twice the permissible disengagement path over which the shaft 10 passes when the spinning assembly is brought to rest.

A stationary shaft 60 is arranged beneath the tangential belt 41 and substantially perpendicular to the direction in which it runs, and near to the tensioning roller 43. A lever 6 with arms 61 and 62 is pivotably mounted on the shaft 60, and is movable from a position of readiness in the direction towards the tangential belt 41, into a disengagement or stopping position. The arms 61 and 62 carry a roller 63 to lift the tangential belt 41 from the shaft 10 and also provides a support for the shaft 10.

A tension spring 7 which engages the free end of the arm 62 tends to urge the lever 6 from its readiness position in the direction towards the tangential belt 41. The lever 6 is held in the readiness position by means of a pull rod 71, which likewise engages the free end of the arm 62 and is connected to a two-armed lever 9 which is pivotable about a shaft 91. The two-armed lever is thus arrested in such a position that it exerts on the lever via the pull rod 71 a tension force which opposes and exceeds the force of the spring 7. Preferably, the arrest of the lever 9 is effected by means of the spinning chamber housing cover 94, which is pivotable about a shaft 95 and on the curved part 93 which abuts a roller 92 of the lever 9.

Over and above this known arrangement, the shaft 10 has, in the neighborhood of the stop 51, a section 12 which tapers conically against its direction of axial support (FIG. 1). The adjunction of this conical section 12 to the stop 51 lying adjacent to the free end of the shaft 10 in the present embodiment does not, however, exclude the possibility of instead making the shaft 10 conical, in the manner shown, in the neighborhood of the stop 50, or also in the region of both stops 50 and 51. The conical structure of the shaft only in the region of one of the stops formed as support mountings has been found to be in itself sufficient. As can be gathered from FIG. 1, the inner wall of the stop 51 also possesses a conicity corresponding to the conical shaft section 12. The feature mentioned above, that the internal diameter of the stop 51 at each point of its conical inner wall corresponds to the respective diameter of the shaft 10 or section 12 together with twice the disengagement path of the shaft, however remains unaffected by this.

Apart from this, the conicity of the shaft section 12 and stop 51 is preferably dimensioned such that the minimal internal diameter of the stop 51 is at least equal to the diameter of the cylindrical part of the shaft 10 adjoining the conical section 12. In this way it is insured that the cylindrical part of the shaft 10 can also pass the stop 51 when it has to be pulled out from its mounting with the shaft 10 when changing the rotor 1.

When the arrest of the lever 9 is released, the spring moves the lever 6 in the direction towards the tangential belt 41, so that the roller 63 lifts the tangential belt 41 from the shaft 10 and also the shaft 10 is lifted, by means of the stop 64 on which a brake lining 65 is appropriately arranged, from the wedge gap of the support rollers 2, 20 and 3, 30, and is pressed against the stops 50 and 51, which are constructed as sliding bearings. An axial force is produced by the mutual action of the conical section 12 of the shaft 10 and the conical wall of the stop 51, and insures the axial securement of the shaft 10 during stopping.

While a preferred embodiment of the invention has been described using specific terms, such description is for illustrative purposes only, and it is to be understood that changes and variations may be made without departing from the spirit or scope of the following claims.

What is claimed is:

1. An apparatus for bringing to rest the rotor of an open end spinning apparatus, a rotor shaft attached to said rotor, freely rotatable support rollers positioned to form a wedge gap, said shaft being mounted in said wedge gap and being pressed against said support rollers, an axial stop, a tangential belt driving said shaft wherein an axial force arising from the support rollers presses said rotor shaft against said axial stop and, in bringing the spinning apparatus to rest, said shaft is moved away from the normal running position on the support rollers to an arrested position off of said support rollers, a pair of spaced stops having bores extending therethrough, said shaft extending through said bores of said spaced stops, a housing including a mounting plate enclosing said axial stop, and one of said spaced stops being carried in said mounting plate, the improvement comprising:

a conically tapering section provided on said shaft tapering inwardly away from said axial stop;

the bore extending through said one of said spaced stops being defined by a surface having a conicity corresponding to the conically tapering section provided on said shaft and being adjacent thereto;

said conically tapering section extending through said bore of said one of said spaced stops and terminating in said housing;

whereby when said shaft is moved from its normal running position to said arrested position, said conically tapering section on said shaft engages said conicity surface of said bore forcing said shaft against said spaced stop.

2. The apparatus according to claim 1 further comprising:

said shaft having an elongated cylindrical portion, and the miminal internal diameter of the conically constructed bore extending through said one of said stops is at least equal to the diameter of said cylindrical portion of said shaft.

* * * * *